US008202000B2

(12) United States Patent
Russick

(10) Patent No.: US 8,202,000 B2
(45) **Date of Patent: *Jun. 19, 2012**

(54) LARGE CAPACITY WASTE DISPOSAL BAG

(75) Inventor: L. David Russick, Shorewood, MN (US)

(73) Assignee: WM Bagco LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/884,877

(22) Filed: Sep. 17, 2010

(65) Prior Publication Data

US 2011/0007984 A1 Jan. 13, 2011

Related U.S. Application Data

(63) Continuation of application No. 11/368,545, filed on Mar. 6, 2006, now Pat. No. 7,798,712.

(51) Int. Cl.
*B65D 33/14* (2006.01)
*B65D 33/00* (2006.01)

(52) U.S. Cl. ..... 383/24; 383/22; 383/33

(58) Field of Classification Search ..... 383/22, 383/24, 33, 15; 294/74
See application file for complete search history.

(56) References Cited

U.S. PATENT DOCUMENTS

| | | | | |
|---|---|---|---|---|
| 3,743,122 | A * | 7/1973 | Fortriede | 414/392 |
| 3,850,367 | A * | 11/1974 | Fortriede | 232/1 B |
| 3,976,113 | A * | 8/1976 | Kim | 383/4 |
| 4,499,599 | A * | 2/1985 | Polett et al. | 383/6 |
| 4,603,432 | A * | 7/1986 | Marino | 383/2 |
| 5,161,853 | A * | 11/1992 | Polett | 383/25 |
| 5,339,872 | A * | 8/1994 | Marino | 141/1 |
| 5,344,109 | A * | 9/1994 | Hokoana, Jr. | 248/100 |
| 5,607,237 | A * | 3/1997 | LaFleur | 383/22 |
| 5,993,062 | A * | 11/1999 | Shackleton | 383/17 |
| 7,798,712 | B2 * | 9/2010 | Russick | 383/24 |
| 8,113,220 | B2 * | 2/2012 | Inglese | 134/104.1 |
| 2002/0164093 | A1 * | 11/2002 | Burkhardt | 383/67 |
| 2010/0111449 | A1 * | 5/2010 | Noble et al. | 383/22 |

FOREIGN PATENT DOCUMENTS

| | | | |
|---|---|---|---|
| EP | 107942 | A2 * | 5/1984 |
| JP | 06024489 | A * | 2/1994 |
| JP | 10095493 | A * | 4/1998 |

* cited by examiner

*Primary Examiner* — Jes F Pascua
(74) *Attorney, Agent, or Firm* — Greenberg Traurig, LLP

(57) ABSTRACT

A large capacity waste disposal bag includes loops attached to it. One set of loops may be used to raise and lower the bag during transportation. Another set of loops may be connected to adjacent loops to support and maintain the bag in an upright, open position. In another embodiment, a large capacity waste disposal bag includes pockets attached to it. When support members are inserted into the pockets the bag is supported and maintained in an upright, open position.

3 Claims, 3 Drawing Sheets

LARGE CAPACITY WASTE DISPOSAL BAG

RELATED APPLICATION

This application is a continuation application of, and claims the benefit of, U.S. application Ser. No. 11/368,545 filed Mar. 6, 2006, now U.S. Pat. No. 7,798,712, the contents of which are incorporated herein by reference.

BACKGROUND

The present disclosure relates to a waste disposal bag. More specifically, the present disclosure relates to a large waste disposal bag which has a capacity of two cubic yards or more and can support itself to maintain an open, upright position.

Large dumpsters are often used for the disposal of construction debris, yard waste, household junk, and other trash or garbage. Due to the unwieldly nature of traditional dumpsters, large plastic or fabric bags potentially could be more convenient to use.

Thus, there is a need for a large capacity waste disposal bag that is capable of maintaining an upright and open position during the filling process. There is also a need in the art for a waste disposal bag, which is easily transported when full.

BRIEF SUMMARY

The present illustrative embodiments allows a waste disposal bag to support and maintain itself in an upright, open position, so it can be easily filled with debris and it also allows the waste disposal bag to be easily lifted for transportation purposes.

The present illustrative embodiments disclose a waste disposal bag, which has loops attached to it. One set of loops may be used to raise and lower the bag during transportation. Another set of loops may be connected to adjacent loops to support and maintain the body in an upright, open position.

In another illustrative embodiment, a self-supporting waste disposal bag system, which has pockets attached to it, is disclosed. The pockets are adapted to receive support members which support and maintain the body in an upright, open position. The bag may also have loops attached to it that are used to raise and lower the bag for transportation purposes. Another set of loops may be attached to the bag which are connectable to adjacent loops to further support and maintain the body in an upright, open position.

DETAILED DESCRIPTION

Figure 1:
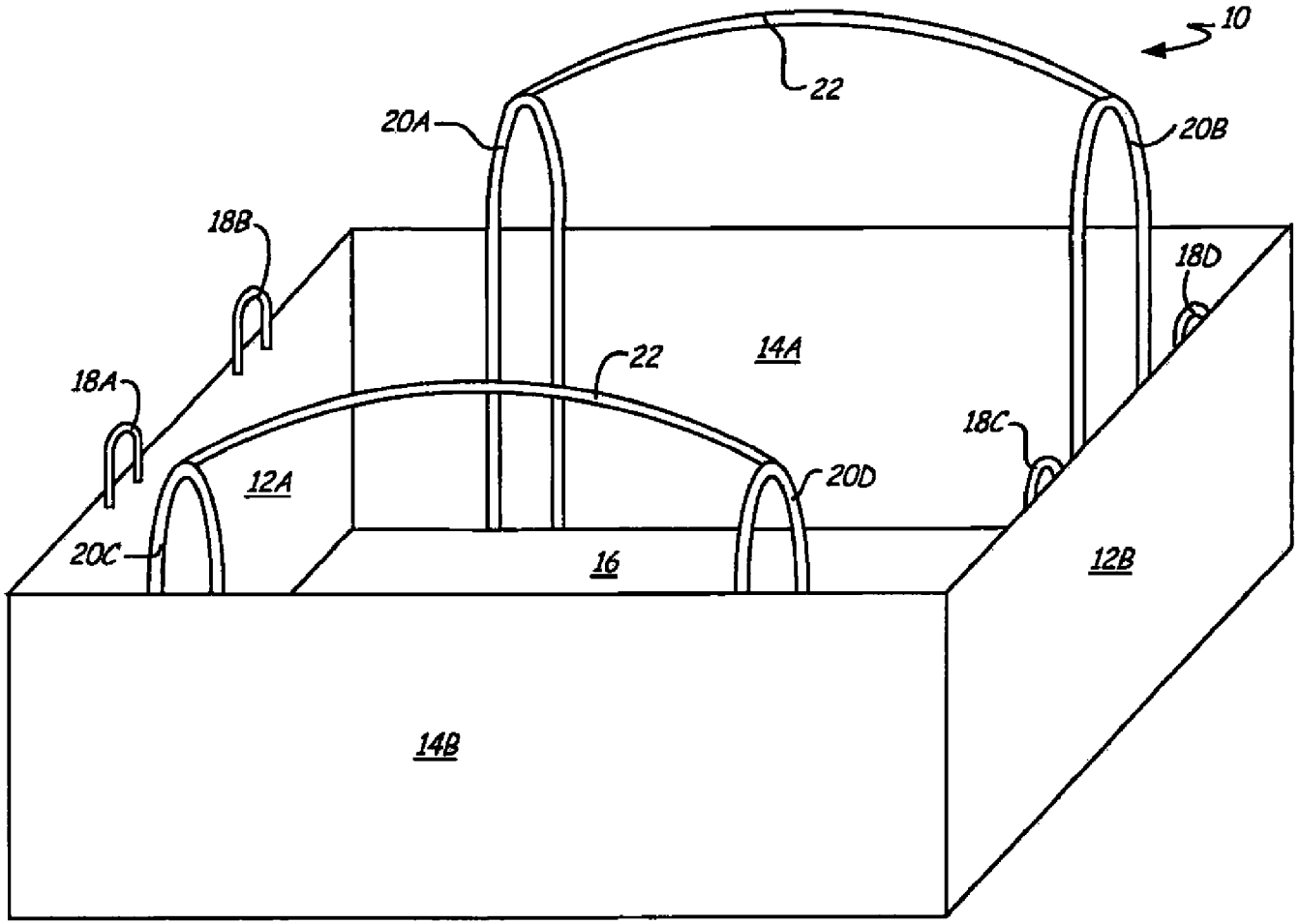
FIG. 1 is a perspective view of a first embodiment of a waste disposal bag.

FIG. 1 is a perspective view of a first embodiment of waste disposal bag 10, which can support itself to maintain an open, upright position. Waste disposal bag 10 is used to contain construction debris, yard waste, household junk, and other trash or garbage.

As shown in FIG. 1, waste disposal bag 10 comprises wall panels 12A, 12B, wall panels 14A, 14B, bottom panel 16, first plurality of loops 18A-18D, and second plurality of loops 20A-20D. However, in other embodiments more or less loops may be used. Waste disposal bag 10 may be any suitable material, which has a tensile strength sufficient to support at least 3,300 lbs., and preferably is comprised of a flexible material, such as woven polypropylene. In addition, waste disposal bag 10 may be collapsible.

Waste disposal bag 10 may be assembled by joining four separate pieces of polypropylene to form wall panels 12A, 12B, 14A and 14B and bottom panel 16 with each piece connected at the seams by stitches. Additionally, a single piece of polypropylene may form bottom panel 16 and wall panels 12A, 12B or wall panels 14A, 14B with the three pieces connected at the seams by stitches. Waste disposal bag 10 is relatively large and has a capacity of about 2 to about 3 cubic yards. When assembled, waste disposal bag 10 weighs approximately 6-7 lbs and is configured to hold up to about 3,300 lbs. In FIG. 1, the 3 cubic yard configuration is shown and the desired dimensions are approximately as follows: wall panels 12A, 12B are about 50 inches long (i.e. width) and about 30 inches high (i.e. height); wall panels 14A, 14B are about 98 inches long (i.e. length) and about 30 inches high (i.e. height); and bottom panel 16 is about 50 inches by about 98 inches. While not shown, the desired 2 cubic yard configuration has a length of about 63 inches, a width of about 36 inches, and a height of about 42 inches. In addition, waste disposal bag 10 can have any combination of dimensions in between the two described configurations.

Loops 18A-18D are made of polypropylene, or another suitable material, and are securely attached to the inside of wall panels 12A and 12B with stitches. In this embodiment, loops 18A-18D extend over the top edge of wall panels 12A, 12B about 11.5 inches and have a width of about 4.5 inches. Loops 18A and 18 B are attached to wall panel 12A and are about 17 inches apart and are located about 12 inches from the nearest corner of waste disposal bag 10. Loops 18C and 18D are attached to wall panel 12B and are also about 17 inches apart and are located about 12 inches from the nearest corner of waste disposal bag 10.

Similarly, loops 20A-20D are made of polypropylene and are securely attached to wall panels 14A, 14B with stitches. Loops 20A-20D extend over the top edge of wall panels 14A, 14B about 12 inches and have a width of about 4.5 inches. Loops 20A and 20B are attached to wall panel 14A and are about 57 inches apart and are located about 15 inches from the nearest corner of waste disposal bag 10. Loops 20C and 20D are attached to wall panel 14B and are about 57 inches apart and are located about 15 inches from the nearest corner of waste disposal bag 10. However, since loops 20A-20D are configured to be used in conjunction with a lifting means, such as a crane, forklift, or other machine, they need to be fastened securely to waste disposal bag 10. Therefore, loops 20A-20D are secured to the inside of wall panels 14A, 14B all the way down to bottom panel 16 for additional strength.

Lifting straps 22 are approximately 62 inches long and are connected between loops 20A and 20B and loops 20C and 20D. Loops 20A-20D are attached to waste disposal bag 10 in a manner that allows them to remain accessible even when waste disposal bag 10 is filled with debris. As a result, when waste disposal bag 10 is full and needs to be transported from the site where it was used, loops 20A-20D are not buried under debris and lifting straps 22 can be easily connected.

Lifting straps 22 are then used in conjunction with a lifting means, such as a forklift, to transport waste disposal bag 10.

Figure 2:
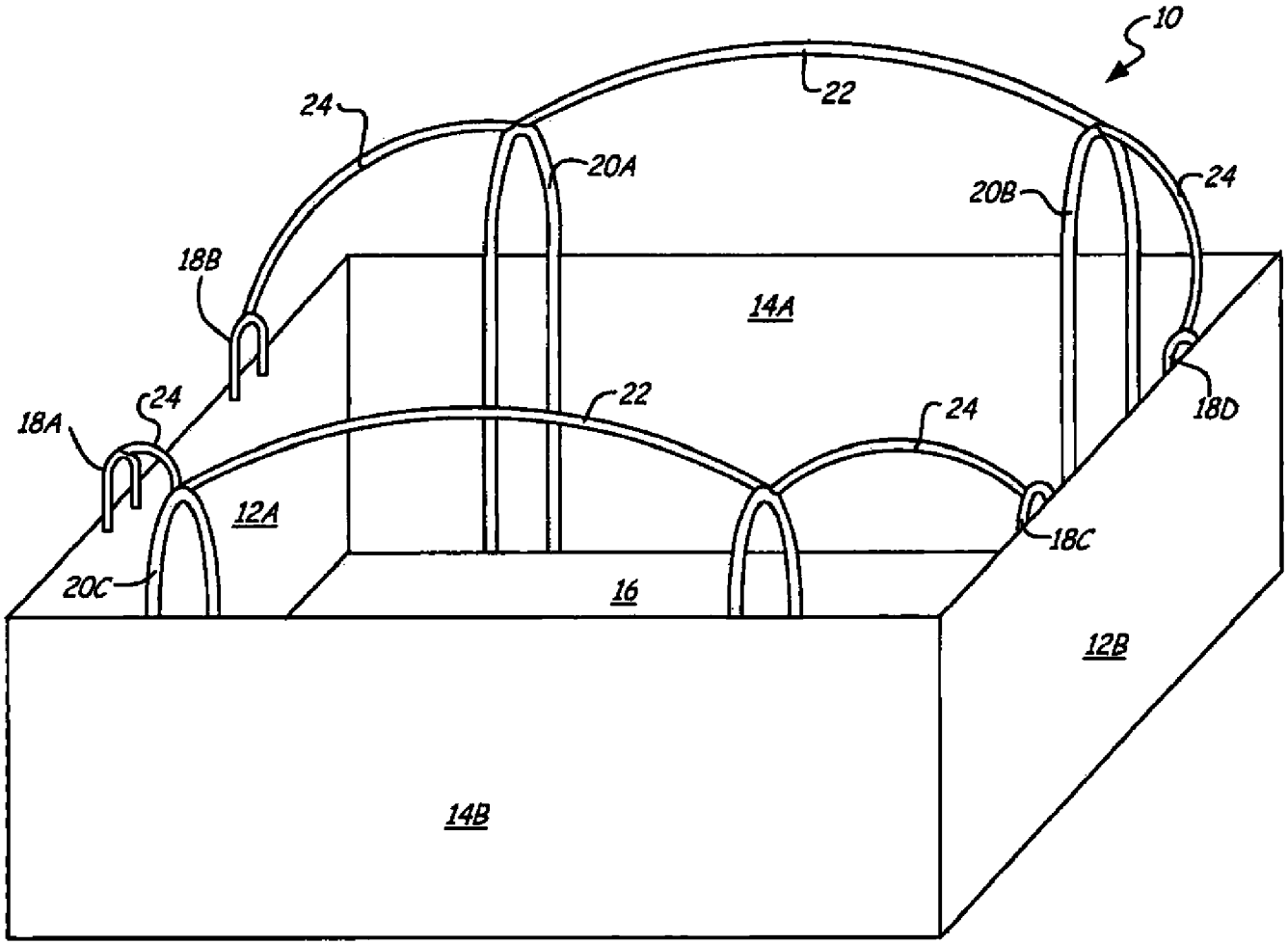
FIG. 2 is a perspective view of the waste disposal bag of FIG. 1 in which a first and second plurality of loops are connected together to provide support for the waste disposal bag.

FIG. 2 is a perspective view of waste disposal bag 10 of FIG. 1 in which loops 18A-18D and loops 20A-20D are connected together to provide support for waste disposal bag 10. Shown in FIG. 2 are waste disposal bag 10, wall panels 12A, 12B, wall panels 14A, 14B, bottom panel 16, loops 18A-18D, loops 20A-20D, lifting straps 22, and loop connectors 24. As described with reference to FIG. 1, waste disposal bag 10 is relatively large, preferably about 2 to about 3 cubic yards capacity, and is comprised of a flexible material. As a result, when waste disposal bag 10 is empty, the pliable sides (i.e. wall panels 12A, 12B, 14A and 14B) of waste disposal bag 10 tend to sag downward. Also, due to its size, the opening of waste disposal bag 10 may droop inward upon itself making it extremely difficult to fill with debris. In addition, when heavy pieces of debris are deposited in waste disposal bag 10, the debris may apply pressure to wall panels 12A, 12B, 14A and/or 14B causing waste disposal bag 10 to tip or the debris to fall out. Loops 18A-18D are connectable with loops 20A-20D to provide support for the waste disposal bag 10. Loop connectors 24 can be comprised of any suitable material, such as fabric rope or tie, a plastic hook, or a metal ring, and are used to connect loops 18A-18D and loops 20A-20D.

As shown, loop 18A is connected to loop 20C, loop 18B is connected to loop 20A, loop 18C is connected to loop 20D, and loop 18D is connected to loop 20B. When loops 18A-18D and loops 20A-20D are connected, tension is exerted on wall panels 12A, 12B, 14A and 14B, which pulls them inward providing support and allowing waste disposal bag 20 to maintain and open, upright position. Depending upon the desired support, two or more loops can be connected.

Figure 3:
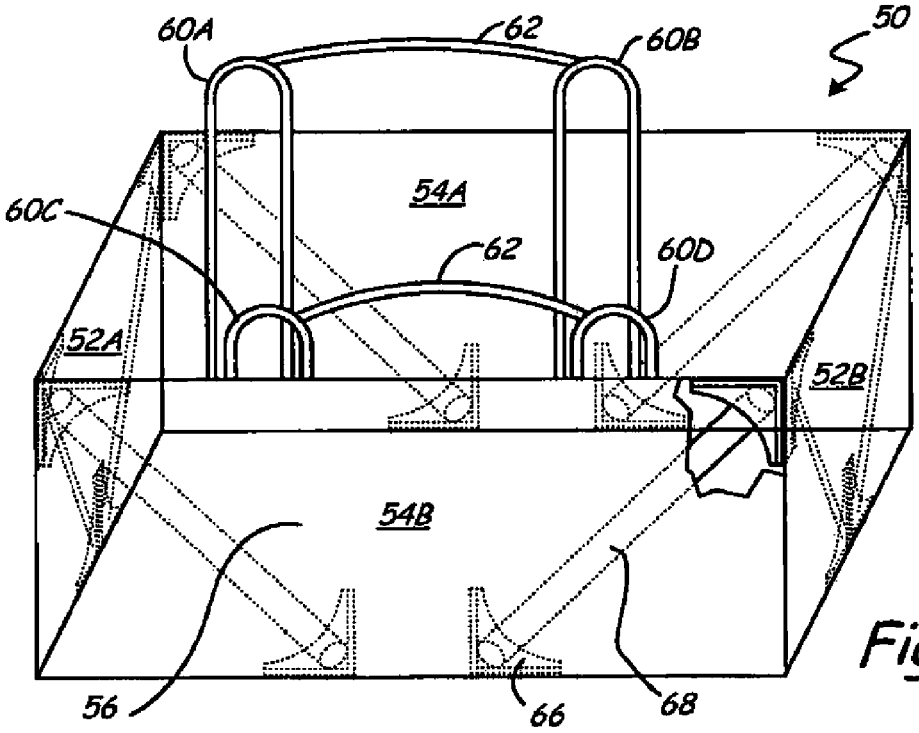
FIG. 3 is a perspective view of a second embodiment of a waste disposal bag having a plurality of pockets and a plurality of support members.

FIG. 3 is a perspective view of a second embodiment of waste disposal bag 50. Shown are wall panels 52A, 52B, wall panels 54A, 54B, bottom panel 56, loops 60A-60D, lifting straps 62, plurality of pockets 66 and plurality of support members 68. Pockets 66 are attached to wall panels 52 and 54 with stitches. Pockets 66 can be any suitable shape and are preferably attached so that a receiving end of each pocket 66 is facing a receiving end of another pocket 66. Support members 68 are inserted into pockets 66 so that the overall angle of each support member with respect to the plane of bottom panel 56 is about 30 degrees to about 60 degrees. The insertion of support members 68 into pockets 66 provides support, which allows waste disposal bag 50 to maintain an upright, open position. Support members 68 may be comprised of any suitable material, such as wood, metal or plastic.

In the embodiment shown in FIG. 3, four pockets 66 are attached to each of wall panels 52A, 52B, 54A and 54B with two pockets 66 placed in each of the upper corners of each wall panel 52A, 52B, 54A and 54B. Four support members 68 are inserted into pockets 66. However, more or less pockets 66 may be used. In addition, depending upon the desired support, one or more support members 66 can be inserted. In addition, if more support is needed, loops, such as loops 18A-18D shown in FIGS. 1 and 2, may be used in conjunction with loops 60A-60D, as described above with reference to FIG. 2. When waste disposal bag 50 is full and needs to be transported, lifting straps 62 are connected between loops 60A and 60B and loops 60C and 60D and are then used in conjunction with a lifting means to transport waste disposal bag 50.

Figure 4:
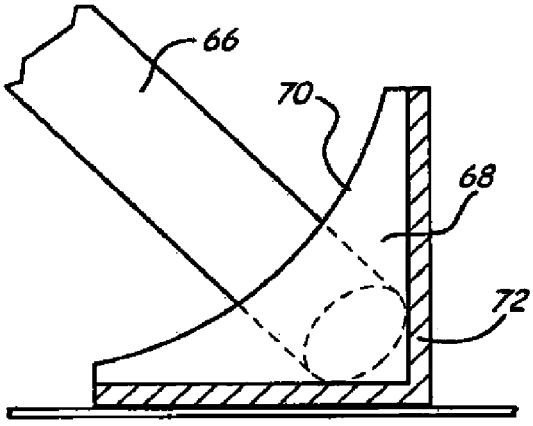
FIG. 4 is a partial sectional view showing a support member which is inserted into a pocket of the waste disposal bag of FIG. 3.

FIG. 4 is a partial sectional view showing support member 68 which is inserted into pocket 66 of waste disposal bag 50 of FIG. 3. Pocket 66 comprises receiving end 70 into which support member 68 is inserted. Pocket 66 may also comprise reinforced edge 72. Reinforced edge 72 reduces the likelihood of pocket 66 tearing or becoming detached when tension is exerted on support member 68.

The present illustrative embodiments have advantages over traditional metal dumpsters in that waste disposal bag 10, 50 can be sold directly through merchandising stores and does not require delivery. Waste disposal bag 10, 50 may be collapsed into a folded configuration for packaging. A customer can, therefore, pick one up at his or her convenience and easily transport it to a home or other usage site. Waste disposal bag 10, 50 is more flexible and lightweight than a dumpster, and when the customer is finished filling it with debris, only one call is required to arrange a pickup time. Additionally, unlike traditional dumpsters which are reused numerous times, waste disposal bag 10, 50 is only used once, so it is sanitary and the customer may keep it as long as he or she wishes.

Although the present illustrative embodiments have been described with reference to preferred embodiments, workers skilled in the art will recognize that changes may be made in form and detail without departing from the spirit and scope of the invention.

The invention claimed is:

1. A waste disposal bag comprising: a bag having a closed bottom, an open top, a first side wall, a second side wall, a first end wall, and a second end wall, wherein the walls define four corners; a first pair of loops attached to and extending above the first side wall, the first pair of loops being spaced apart from each other and spaced apart from the corners; a second pair of loops attached to and extending above the second side wall, the second pair of loops being spaced apart from each other and spaced apart from the corners; a first lifting strap extending between and connecting top portions of the first pair of loops; and a second lifting strap individually distinct from the first lifting strap and extending between and connecting top portions of the second pair of loops, the loops extending in a first direction and the lifting straps extending in a second, different direction, wherein the second direction is substantially other than parallel to the bottom panel when the bag is in an open and upright position and the bag is filed with waste, and wherein the first and second lifting straps are configured to receive a lifting means and distribute lifting force down through the first and second pairs of loops and around the walls of the bag, wherein the first pair of loops are secured to the inside of the first side wall and the second pair of loops are secured to the inside of the second side wall all the way down to the bottom panel.

2. The bag of claim 1, wherein the first lifting strap and second lifting strap having lengths such that the straps are accessible and connectable when the bag is filled with waste.

3. The bag of claim 1, wherein the side walls are longer than the end walls.

* * * * *